US008123020B2

(12) United States Patent
Fang et al.

(10) Patent No.: US 8,123,020 B2
(45) Date of Patent: Feb. 28, 2012

(54) EASILY DISMANTLED ESCALATOR OUTER DECKING

(75) Inventors: Yongqing Fang, Hangzhou (CN); Jianguo Li, Hangzhou (CN); Mingping Jiang, Hangzhou (CN)

(73) Assignee: Otis Elevator Company, Farmington, CT (US)

( * ) Notice: Subject to any disclaimer, the term of this patent is extended or adjusted under 35 U.S.C. 154(b) by 305 days.

(21) Appl. No.: 12/376,183

(22) PCT Filed: Aug. 15, 2007

(86) PCT No.: PCT/CN2007/002457

§ 371 (c)(1),
(2), (4) Date: Oct. 1, 2009

(87) PCT Pub. No.: WO2008/022551

PCT Pub. Date: Feb. 28, 2008

(65) Prior Publication Data

US 2010/0101915 A1 Apr. 29, 2010

(30) Foreign Application Priority Data

Aug. 18, 2006 (CN) ..... 2006 1 0053009

(51) Int. Cl.
*B66B 23/00* (2006.01)

(52) U.S. Cl. ..... 198/335; 198/337; 198/338

(58) Field of Classification Search ..... 198/335, 198/337, 338
See application file for complete search history.

(56) References Cited

U.S. PATENT DOCUMENTS 4,646,907 A * 3/1987 Streibig et al. ..... 198/335
4,819,781 A * 4/1989 Saito et al. ..... 198/335
5,029,690 A * 7/1991 Nguyen et al. ..... 198/335
5,156,251 A * 10/1992 Johnson ..... 198/335
5,180,047 A * 1/1993 Barrett et al. ..... 198/335
(Continued)

FOREIGN PATENT DOCUMENTS

DE 20208883 U1 8/2002
(Continued)

OTHER PUBLICATIONS

Written Opinion of the International Searching Authority and International Search Report for International application No. PCT/CN2007/002457 mailed Nov. 22, 2007.

(Continued)

*Primary Examiner* — Douglas Hess
(74) *Attorney, Agent, or Firm* — Carlson, Gaskey & Olds PC

(57) ABSTRACT

An easily dismantled escalator outer decking, the escalator including a handrail system bracket and a balustrade panel, the escalator outer decking including cover plate (1), wherein the escalator outer decking also includes a first bracket (3) mounted on the handrail system bracket (5), a retention member (2) secured to the cover plate (1) and an insertion strip (8), wherein the retention member (2) is connected to the first bracket (3) in a manner of embedding or snapping, and the insertion strip (8) is wedged between the cover plate (1) and the balustrade panel (9); such that when the outer decking is disassembled, the cover plate (1) and the retention member (2) can be taken down together by putting away the insertion strip (8) first and then lifting the cover plate (1) and the retention member (2) or pushing them towards the balustrade panel (9). The escalator outer decking the present invention has good configuration and can be dismantled easily during maintenance.

24 Claims, 7 Drawing Sheets

U.S. PATENT DOCUMENTS

| | | | | |
|---|---|---|---|---|
| 5,186,302 | A * | 2/1993 | Johnson et al. | 198/335 |
| 5,205,391 | A * | 4/1993 | Nurnberg et al. | 198/325 |
| 5,215,177 | A * | 6/1993 | Johnson et al. | 198/335 |
| 5,284,237 | A * | 2/1994 | Mello et al. | 198/335 |
| 5,458,220 | A * | 10/1995 | Nguyen et al. | 198/335 |
| 5,542,522 | A * | 8/1996 | Adrian et al. | 198/337 |
| 6,082,520 | A * | 7/2000 | Kleewein et al. | 198/335 |
| 7,581,631 | B2 * | 9/2009 | Aulanko et al. | 198/321 |
| 2007/0007107 | A1 | 1/2007 | Kuhnert et al. | |

FOREIGN PATENT DOCUMENTS

| | | | |
|---|---|---|---|
| EP | 1531140 | A1 | 5/2005 |
| JP | 2000211871 | A | 8/2000 |
| JP | 2002332185 | A | 11/2002 |

OTHER PUBLICATIONS

International Preliminary Report on Patentability for International application No. PCT/CN2007/002457 mailed Jan. 8, 2009.

* cited by examiner

EASILY DISMANTLED ESCALATOR OUTER DECKING

TECHNICAL FIELD

This invention relates to an escalator outer decking, and more particularly, to an easily dismantled escalator outer decking.

BACKGROUND ART

Outer decking is a necessary part of an escalator or a moving walkway. The outer decking needs to be dismantled for easy replacement of parts during maintenance. There are several ways of securing the outer decking of an escalator or a moving walkway at present. One is that the outer decking 1' is secured to a handrail system bracket 5' by T-shaped bolts 12, see FIG. 6. When disassembling, the outer decking 1' can be taken down only after the inner decking of handrail system is taken down first, even the skirting board needs to be taken down. Another is that the outer decking 1' is mounted by side screws 13, see FIG. 7. In this case, if the escalator abuts against structure of building or a paratactic escalator, the outer decking 1' can not be dismantled.

BRIEF SUMMARY OF THE INVENTION

It is an objective of the present invention to provide an escalator outer decking, which has good configuration and can be easily dismantled during maintenance.

The foregoing objective is attained by the easily dismantled escalator outer decking of the present invention.

According to the present invention, an escalator includes a handrail system bracket, a balustrade panel and a balustrade panel clamping member; and an escalator outer decking includes a cover plate, a first bracket, a retention member and an insertion strip. The first bracket is mounted on the handrail system bracket. The retention member has an open end and a closed end; the closed end of the retention member is secured to the underside of the cover plate while the open end is connected to the first bracket in a manner of embedding or snapping. The insertion strip is wedged between the cover plate and the balustrade panel.

When disassembling, the cover plate and the retention member can be taken down together by removing the insertion strip first and then uplifting the cover plate and the retention member or pushing them towards the balustrade panel.

In one exemplary embodiment, the manner of connecting the retention member to the first bracket is that at the side closest to the balustrade panel, a crooking portion that faces away from the balustrade panel is formed at the end of the retention member, and a gap that faces towards the balustrade panel, into which the crooking portion can be inserted, is formed correspondingly on the first bracket; and at the side away from the balustrade panel, a projecting portion that faces away from the balustrade panel is formed at the end of the retention member, and a groove that faces towards the balustrade panel, into which the projecting portion can be fitted, is formed correspondingly on the first bracket. In the illustrative embodiment, the retention member and the first bracket can be taken down together by pushing them towards the balustrade panel. A second bracket may also be provided between the cover plate and the balustrade panel clamping member. In the illustrative embodiment, the second bracket is snapped onto the balustrade panel clamping member and is secured to the underside of the cover plate for example, by screws.

In another embodiment, a leaf spring is provided between the retention member and the first bracket to hold the retention member in place. Preferably, the leaf spring is upside-down V-shaped.

Alternatively, the retention member and the first bracket can be connected in such a manner that at the side closest to the balustrade panel, a bulge that faces towards the balustrade panel is formed at the end of the retention member, and a notch that faces away from the balustrade panel, into which the bulge can be fitted, is formed correspondingly on the first bracket; and at the side away from the balustrade panel, a projecting portion that faces away from the balustrade panel is formed at the end of the retention member, and a groove that faces towards the balustrade panel, into which the projecting portion can be fitted, is formed correspondingly on the first bracket. In yet another embodiment, the side of the first bracket that is closest to the balustrade panel is upright or curved, such as S-shaped member.

In the illustrative embodiments of the present invention, the first bracket is mounted on the handrail system bracket, for example by bolts, and the retention member is secured to the underside of the cover plate, for example by bonding.

Additionally, in the escalator outer decking according to the present invention, the positions of the first bracket and the retention member are interchangeable.

In the escalator outer decking according to the present invention, the cover plate is mounted to the balustrade system bracket by simple connection such as, for example, embedding or snapping between the retention member and the first bracket. Comparing with the prior art, the escalator outer decking in accordance with the present invention is easy to assemble and disassemble. When disassembling, it is only needed to remove the insertion strip, then uplift the cover plate and the retention member or push them towards the balustrade panel, and thus the cover plate and the retention member can be taken down together. Such an escalator outer decking can be dismantled easily, and be free from structure of buildings and paratactic escalators.

PREFERRED EMBODIMENTS OF THE INVENTION

The First Embodiment

Figure 1:
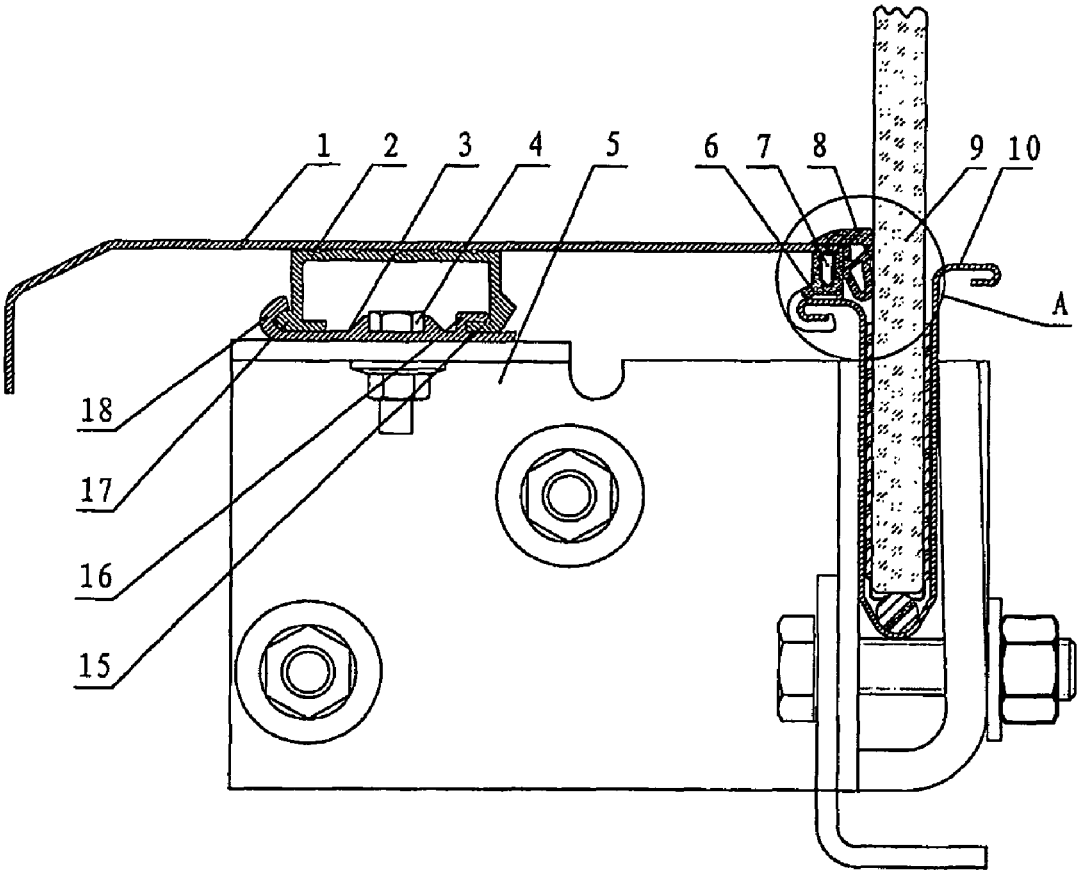
FIG. 1 is a schematic view showing the structure of the first embodiment of an escalator outer decking in accordance with the present invention.
Figure 2:
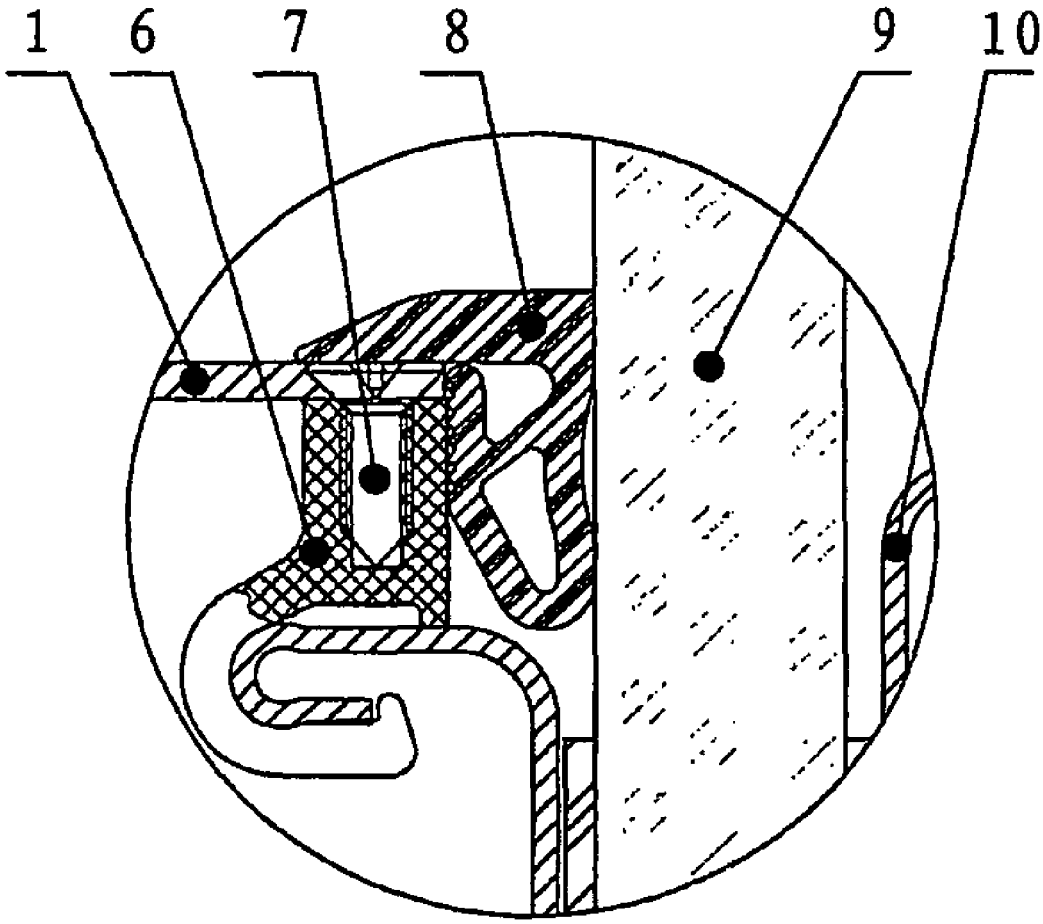
FIG. 2 is an enlarged view taken from the area A of FIG. 1.

Referring to FIGS. 1 and 2, in this embodiment, a first bracket 3 is mounted on the handrail system bracket 5 by bolts 4. A retention member 2 is open at one end and close at the other end. The closing end of the retention member 2 is secured beneath a cover plate 1 by bonding, such as using AB glue, and thus integrated with the cover plate. The opening end of the retention member 2 is connected to the upside of the first bracket 3. A balustrade panel 9 (which, in many modern escalators, is a glass panel, the so-called balustrade glass) is seated in a balustrade panel clamping member 10. As shown in FIG. 1, the retention member 2 has a crooking portion away from the balustrade panel 9 at the end of the side close to the balustrade panel 9, while the first bracket 3 has a transverse gap correspondingly, into which the crooking portion can be inserted. The retention member 2 is connected with the first bracket 3 in such a manner of embedding that the retention member 2 cannot move upwards, downwards or away from the balustrade panel 9. When the retention member 2 is moved towards the balustrade panel 9 for some distance, the crooking portion can be released from the gap, and thus the retention member 2 is separated from the first bracket 3.

The retention member 2 has a projecting portion 17 that faces away from the balustrade panel 9, that is semicircular in its cross-section, at its end of the side away from the balustrade panel 9, while the first bracket 3 has a matched groove 18 that faces towards the balustrade panel 9, into which the projecting portion can be fitted, correspondingly. The function of such structure is similar to that of the crooking portion 15 of the retention member 2 and the gap 16 of the first bracket 3; both are used for limiting movement of the retention member and cover plate upwards, downwards or away from the balustrade panel 9. However, the difference between these structures is that the interface between the projecting portion and the groove is a cylindrical surface that permits the retention member 2 to rotate relative to the first bracket 3 for some degree (such design is more useful in the Second and Third Embodiments described below).

A second bracket 6 is provided between the cover plate 1 and the balustrade panel clamping member 10. It can be seen clearly in FIG. 2 that the second bracket 6 can be (f) snapped onto the balustrade panel clamping member 10 and secured to the underside of the cover plate 1, for example by screws 7. Therefore, the cover plate 1 can be fixed in position. The second bracket 6 can be made from plastic or other similar material.

An insertion strip 8 is wedged between the cover plate 1 and the balustrade panel 9. It can both fill the gap between the cover plate 1 and the balustrade panel 9 and hold other parts in place.

The retention member 2 is preferably π-shaped (or upside-down "U" shaped) in its cross-section, and may be formed by being extruded from a material such as aluminum alloy. The first bracket 3 may be made from spring steel or other similar material.

When disassembling, first the insertion strip 8 is removed, then the cover plate 1 and the retention member 2 are pushed towards the balustrade panel 9 for some distance, and then the retention member 2 is disengaged from the first bracket 3, from where they are connected, so the cover plate 1 and the retention member 2 can be removed together.

The Second Embodiment

Figure 3:
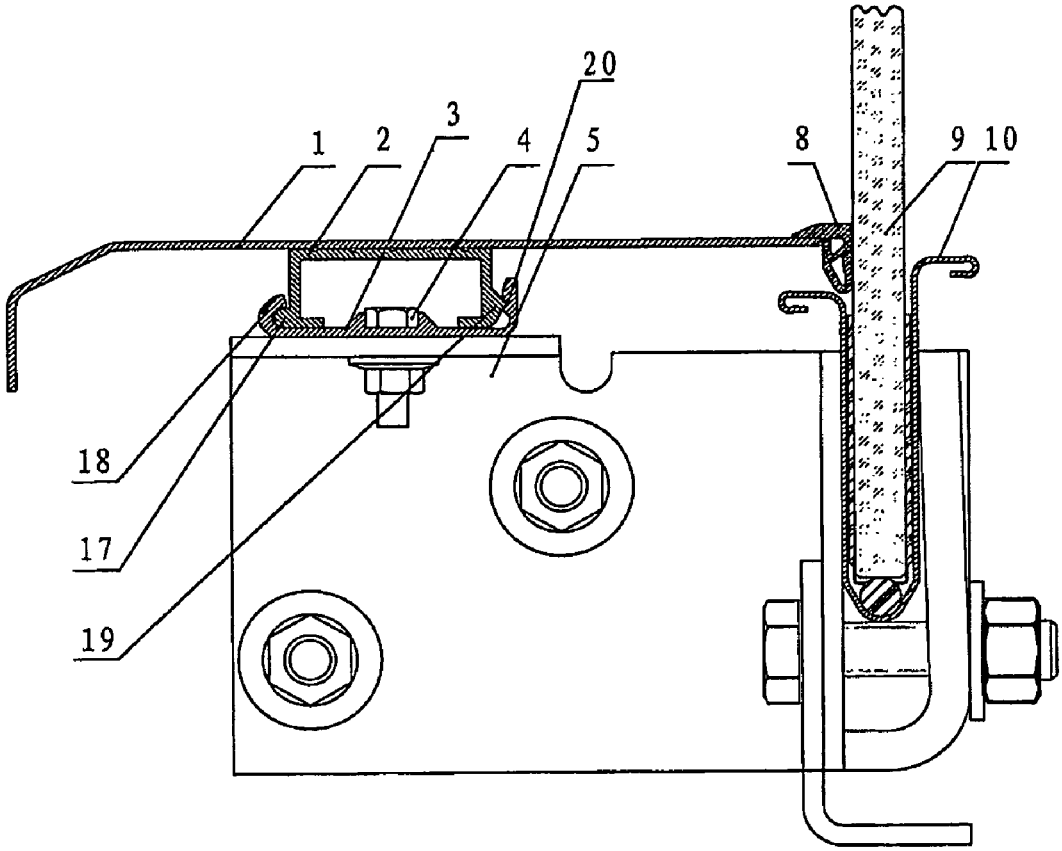
FIG. 3 is a schematic view showing the structure of the second embodiment of the escalator outer decking in accordance with the present invention.

Referring to FIG. 3, this embodiment is the same as the First Embodiment at the side of the retention member 2 away from the balustrade panel 9. In this embodiment, however, the side of the first bracket 3 close to the balustrade panel 9 is upright, on which a notch 20 is provided that faces away from the balustrade panel 9. A bulge 19 is formed correspondingly that faces towards the balustrade panel 9 on the side of the retention member 2. The retention member 2 is connected with the first bracket 3 for example, by snapping.

Since the movement of the retention member 2 towards the balustrade panel 9 is prevented by the upright portion of the first bracket 3, the second bracket 6 in the First Embodiment is unnecessary here. An insertion strip 8 is also wedged between the cover plate 1 and the balustrade panel 9.

When disassembling, first the insertion strip 8 is removed, the cover plate 1 and the retention member 2 are lifted from the side close to the balustrade panel 9, and then the cover plate 1 and the retention member 2 are rotated relative to the first bracket 3 for some degree and the retention member 2 is disengaged with the first bracket 3 from where it is connected, thus the cover plate 1 and the retention member 2 can be taken down together.

The Third Embodiment

Figure 4:
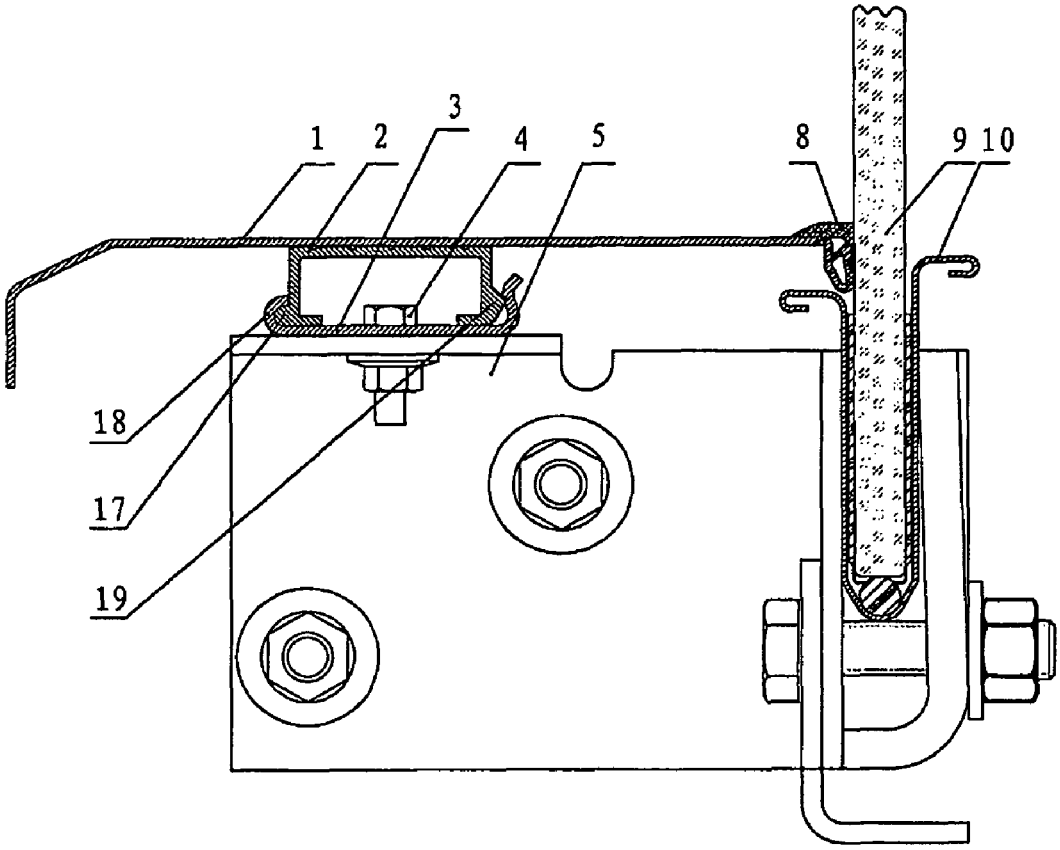
FIG. 4 is a schematic view showing the structure of the third embodiment of the escalator outer decking in accordance with the present invention.

Referring to FIG. 4, this embodiment is similar to the Second Embodiment, except that the side of the first bracket 3 closest to the balustrade panel 9 is curved or S-shaped.

The way for removing the cover plate 1 and the retention member 2 is same as that of the Second Embodiment.

The Fourth Embodiment

Figure 5:
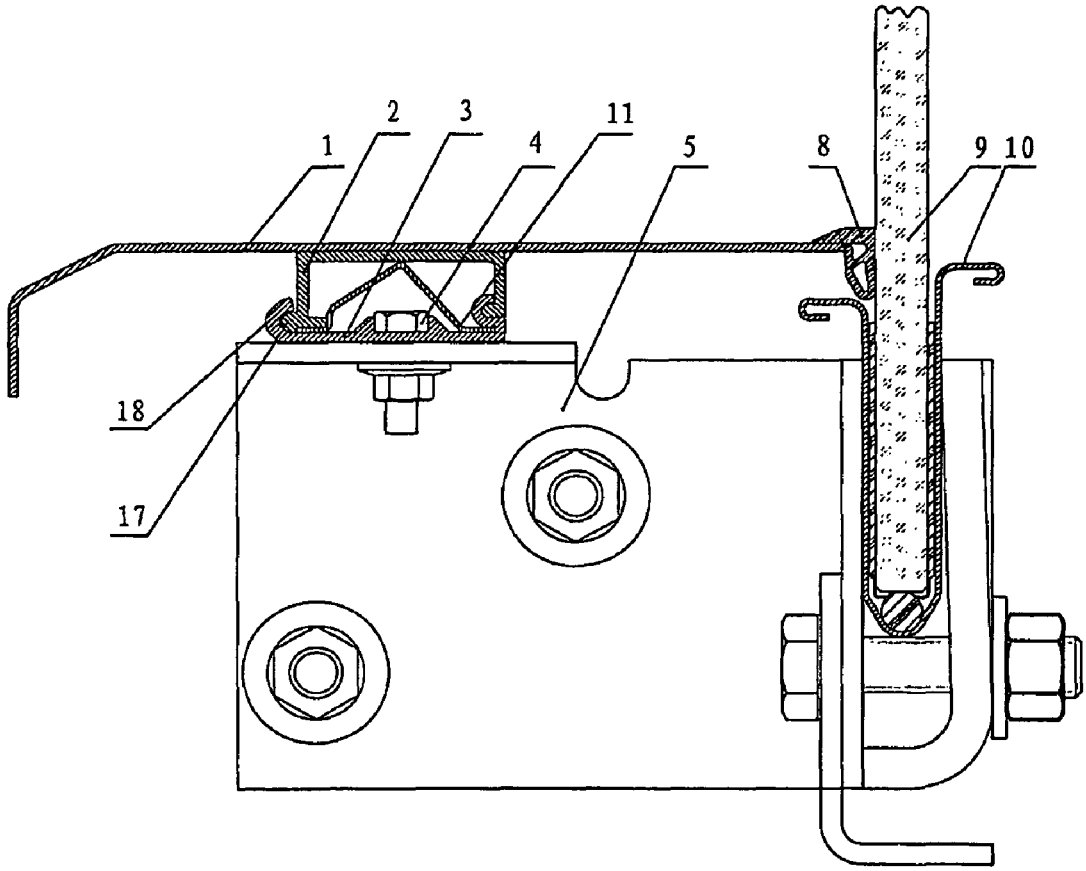
FIG. 5 is a schematic view showing the structure of the fourth embodiment of the escalator outer decking in accordance with the present invention.
Figure 6:
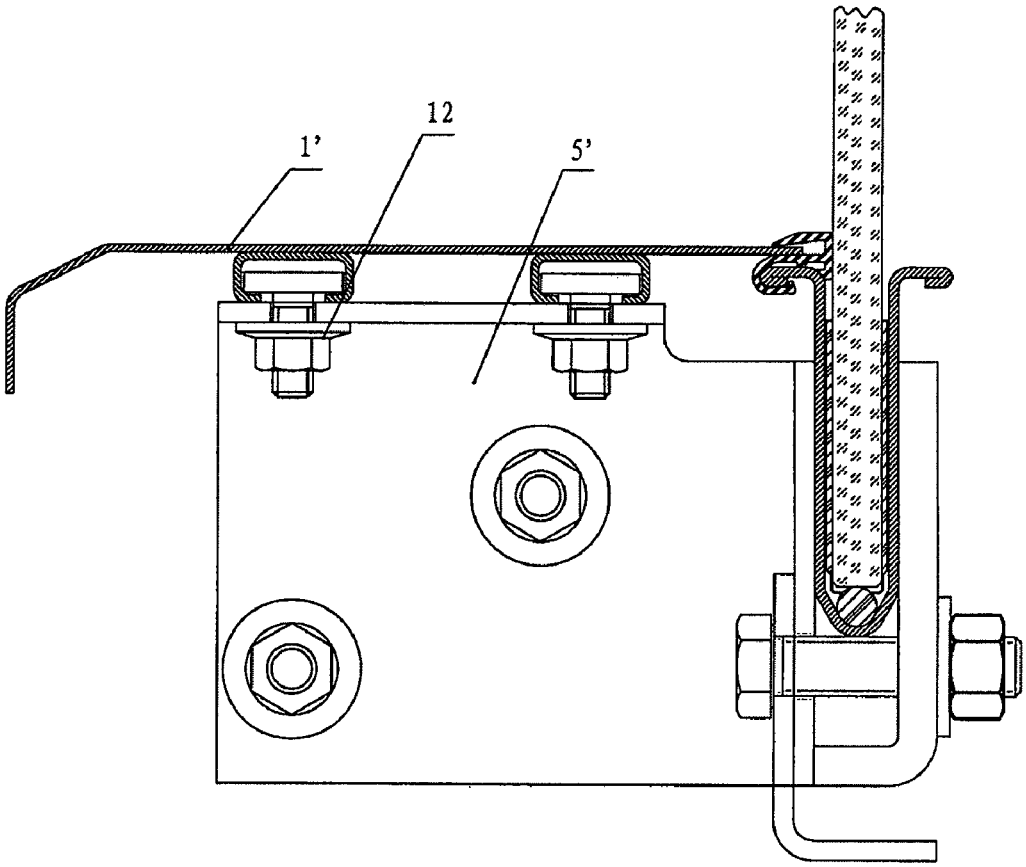
FIG. 6 PRIOR ART
FIG. 6 is a schematic view showing the first structure of an escalator outer decking of the prior art.
Figure 7:
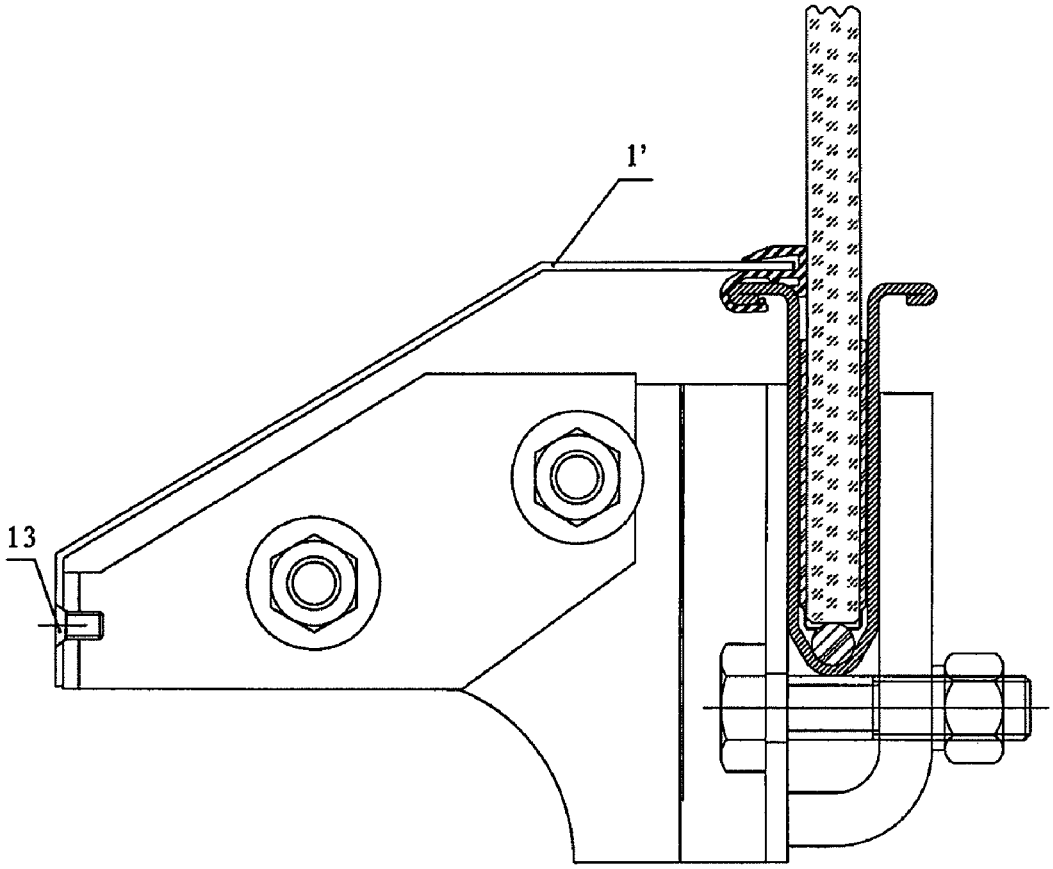
FIG. 7 PRIOR ART
FIG. 7 is a schematic view showing the second structure of the escalator outer decking of the prior art.

Referring to FIG. 5, in this embodiment, retention member 2 is connected to the first bracket 3 at both sides in a manner of embedding, similar to the First Embodiment, but the difference is that a leaf spring 11 is provided between the retention member 2 and the first bracket 3. The leaf spring 11 can limit the movement of retention member 2 towards the balustrade panel 9 to some degree and keep the retention member 2 in the state of embedding on the first bracket 3. As shown in the illustrative embodiment, the leaf spring 11 may have an upside-down V-shape. No second bracket 6 is provided between the cover plate 1 and the glass clamping member 10 in this embodiment.

The way for taking down the cover plate 1 and the retention member 2 is same as that of the First Embodiment.

Additionally, it will be understood by a person skilled in the art that the positions of the first bracket 3 and the retention member 2 can be interchanged in all of the above embodiments, i.e. the first bracket 3 can be secured to the underside of the cover plate 1 while the retention member 2 can be mounted on the handrail system bracket 5. In this case, the orientation of the connection portion (the crooking portion 15 and the gap 16, the projecting portion 17 and the groove 18, the bulge 19 and the notch 20) of the first bracket 3 and the retention member 2 may need to be adjusted accordingly.

The present invention may be embodied in other specific forms without departing from the spirit or essence thereof. Various adaptations and modifications of the invention will be obvious to those skilled in the art. Therefore, the presently discussed embodiments are considered to be illustrative and not restrictive, the scope of the invention will be indicated by the appended claims rather than the foregoing description, and all changes which come within the meaning and range of equivalency of the claims are therefore intended to be embraced therein.

The invention claimed is:

1. An escalator outer decking, the escalator including a handrail system bracket and a balustrade panel, wherein the escalator outer decking includes a cover plate, wherein the escalator outer decking also includes a first bracket, a retention member and an insertion strip, the first bracket is mounted on the handrail system bracket, the retention member has an open end and a closed end, wherein the closed end of the retention member is secured to the underside of the cover plate and the open end of the retention member is connected to the first bracket in a manner of embedding or snapping, and wherein the insertion strip is wedged between the cover plate and the balustrade panel; such that when disassembling, the cover plate and the retention member can be taken down together by putting away the insertion strip first and then lifting the cover plate and the retention member or pushing the cover plate and the retention member towards the balustrade panel.

2. An escalator outer decking as claimed in claim 1, wherein at the side of the retention member closest to the balustrade panel, a crooking portion that faces away from the balustrade panel is formed at the end of the retention member, while a gap that faces towards the balustrade panel, into which the crooking portion can be inserted, is formed correspondingly on the first bracket; and at the side of the retention member away from the balustrade panel, a projecting portion that faces away from the balustrade panel is formed at the end of the retention member, while a groove that faces towards the balustrade panel, into which the projecting portion can be fitted, is formed correspondingly on the first bracket.

3. An escalator outer decking as claimed in claim 2, wherein the escalator further includes a balustrade panel clamping member, and a second bracket provided between the cover plate and the balustrade panel clamping member, wherein the second bracket is snapped onto the balustrade panel clamping member and is secured to the underside of the cover plate by screws.

4. An escalator outer decking as claimed in claim 2, wherein a leaf spring is provided between the retention member and the first bracket.

5. An escalator outer decking as claimed in claim 4, wherein the leaf spring is upside-down V-shaped.

6. An escalator outer decking as claimed in claim 1, wherein at the side of the retention member closest to the balustrade panel, a bulge that faces towards the balustrade panel is formed at the side of the retention member, while a notch that is away from the balustrade panel, into which the bulge can be fitted, is formed correspondingly on the first bracket; and at the side of the retention member away from the balustrade panel, a projecting portion that faces away from the balustrade panel is formed at the end of the retention member, while a groove that faces towards the balustrade panel, into which the projecting portion can be fitted, is formed correspondingly on the first bracket.

7. An escalator outer decking as claimed in claim 6, wherein the side of the first bracket close to the balustrade panel is upright.

8. An escalator outer decking as claimed in claim 6, wherein the side of the first bracket close to the balustrade panel is curved.

9. An escalator outer decking as claimed in claim 1, wherein the first bracket is mounted on the handrail system bracket by bolts.

10. An escalator outer decking as claimed in claim 1, wherein the retention member is secured to the underside of the cover plate by bonding.

11. An escalator outer decking, the escalator including a handrail system bracket and a balustrade panel, wherein the escalator outer decking includes a cover plate, wherein the escalator outer decking also includes a first bracket, a retention member and an insertion strip, wherein the first bracket is secured to the underside of the cover plate, the retention member has an open end and a closed end, the closed end of the retention member is mounted on the handrail system bracket and the open end of the retention member is connected to the first bracket in a manner of embedding or snapping, and wherein the insertion strip is wedged between the cover plate and the balustrade panel; such that when disassembling, the cover plate and the first bracket can be taken down together by putting away the insertion strip first and then lifting the cover plate and the first bracket or pushing the cover plate and the first bracket towards the balustrade panel.

12. An escalator outer decking as claimed in claim 11, wherein at the side of the retention member closest to the balustrade panel, a crooking portion that faces towards the balustrade panel is formed at the end of the retention member, while a gap that faces away from the balustrade panel, into which the crooking portion can be inserted, is formed correspondingly on the first bracket; and at the side of the retention member away from the balustrade panel, a projecting portion that faces towards the balustrade panel is formed at the end of retention member, while a groove that faces away from the balustrade panel, into which the projecting portion can be fitted, is formed correspondingly on the first bracket.

13. An escalator outer decking as claimed in claim 12, wherein the escalator further includes a balustrade panel clamping member, and a second bracket provided between the cover plate and the balustrade panel clamping member, wherein the second bracket is snapped onto the balustrade panel clamping member and is secured to the underside of the cover plate by screws.

14. An escalator outer decking as claimed in claim 12, wherein a leaf spring is provided between the retention member and the first bracket.

15. An escalator outer decking as claimed in claim 14, wherein the leaf spring is V-shaped.

16. An escalator outer decking as claimed in claim 11, wherein at the side of the retention member closest to the balustrade panel, a bulge that faces towards the balustrade panel is formed at the side of the retention member, while a notch that faces away from the balustrade panel, into which the bulge can be fitted, is formed correspondingly on the first bracket; and at the side of the retention member away from the balustrade panel, a projecting portion that faces away from the balustrade panel is formed at the retention member, while a groove that faces towards the balustrade panel, into which the projecting portion can be fitted, is formed correspondingly on the first bracket.

17. An escalator outer decking as claimed in claim 16, wherein the side of the first bracket close to the balustrade panel is upright.

18. An escalator outer decking as claimed in claim 16, wherein the side of the first bracket closest to the balustrade panel is curved.

19. An escalator outer decking as claimed in claim 11, wherein the retention member is mounted on the handrail system bracket by bolts.

20. An escalator outer decking as claimed in claim 11, wherein the first bracket is secured to the underside of the cover plate by bonding.

21. An outer decking for an escalator including a handrail system bracket and a balustrade panel, the escalator outer decking including a cover plate, a first member mounted on the handrail system bracket, a second member secured to the cover plate, and an insertion strip, wherein the second member is detachably connected to the first member, and wherein the insertion strip is wedged between the cover plate and the balustrade panel, the insertion strip being removable when the cover plate is received against the insertion strip and the second member is attached to the first member; such that the outer decking is disassembled by first removing the insertion strip and then moving the cover plate and the second member in a selected direction relative to the balustrade panel.

22. An outer decking for an escalator as claimed in claim 21, wherein the outer decking is disassembled by first removing the insertion strip and then lifting the cover plate and second member.

23. An outer decking for an escalator as claimed in claim 21, wherein the outer decking is disassembled by first removing the insertion strip and then pushing the cover plate and second member towards the balustrade panel.

24. An outer decking for an escalator as claimed in claim 21, wherein the outer decking is disassembled by first removing the insertion strip and then rotating the cover plate and second member about the detachable connection of the second member and first member.

* * * * *